US008294340B2

(12) United States Patent
Yu et al.

(10) Patent No.: US 8,294,340 B2
(45) Date of Patent: Oct. 23, 2012

(54) HEAT DISSIPATION DEVICE AND LED LAMP USING THE SAME

(75) Inventors: Guang Yu, Shenzhen (CN); Qian Xiang, Shenzhen (CN)

(73) Assignees: Fu Zhen Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 228 days.

(21) Appl. No.: 12/943,012

(22) Filed: Nov. 10, 2010

(65) Prior Publication Data

US 2012/0098400 A1 Apr. 26, 2012

(30) Foreign Application Priority Data

Oct. 22, 2010 (CN) ..... 2010 1 0516268

(51) Int. Cl.
*H01J 1/02* (2006.01)

(52) U.S. Cl. ..... 313/46; 362/241; 362/294

(58) Field of Classification Search ..... 313/46; 362/241, 294
See application file for complete search history.

(56) References Cited

U.S. PATENT DOCUMENTS

| | | | | |
|---|---|---|---|---|
| 7,011,431 | B2 * | 3/2006 | Ono et al. | 362/241 |
| 7,568,817 | B2 * | 8/2009 | Lee et al. | 362/294 |
| 8,053,960 | B2 * | 11/2011 | Liu et al. | 313/46 |
| 2008/0093962 | A1 * | 4/2008 | Kim et al. | 313/46 |
| 2008/0258598 | A1 * | 10/2008 | Shuy | 313/46 |
| 2009/0015125 | A1 * | 1/2009 | Shuy | 313/46 |
| 2009/0261707 | A1 * | 10/2009 | Liu et al. | 313/46 |
| 2010/0207502 | A1 * | 8/2010 | Cao et al. | 313/46 |
| 2010/0264800 | A1 * | 10/2010 | Liu et al. | 313/46 |
| 2011/0050124 | A1 * | 3/2011 | Bailey et al. | 315/294 |
| 2011/0156568 | A1 * | 6/2011 | Chen et al. | 313/46 |
| 2011/0285267 | A1 * | 11/2011 | Lu et al. | 313/46 |

* cited by examiner

*Primary Examiner* — Mary Ellen Bowman
(74) *Attorney, Agent, or Firm* — Altis Law Group, Inc.

(57) ABSTRACT

A heat dissipation device includes a heat absorption board adapted for contacting a light source to absorb heat therefrom, a fin assembly located over the heat absorption board, two spaced heat pipes each comprising an evaporator section and two condenser sections extending from two opposite ends of the evaporator section, and a heat sink located between the heat absorption board and the fin assembly. The condenser sections extend through the fin assembly. The evaporator sections of the heat pipes are sandwiched between the heat sink and the heat absorption board. The heat sink includes alternate first and second heat dissipating branches extending outwardly from a central portion thereof. The first heat dissipating branches contact the evaporator sections of the heat pipes. The second heat dissipating branches are located between the heat pipes.

16 Claims, 4 Drawing Sheets

HEAT DISSIPATION DEVICE AND LED LAMP USING THE SAME

BACKGROUND

1. Technical Field

The disclosure generally relates to a heat dissipation device and an LED lamp using the same.

2. Description of Related Art

A conventional heat dissipation device includes a heat absorption board adapted for absorbing heat generated by a heat generating component, a fin assembly located over the heat absorption board, a plurality of heat pipes thermally connecting the heat absorption board and the fin assembly, and a heat sink thermally contacting the heat absorption board. Each of the heat pipes includes an evaporator section and two condenser sections extending upwardly from two opposite ends of the evaporator section. The heat sink has an elongated configuration. The heat sink extends along a length direction thereof and is thermally coupled to the evaporator sections of the heat pipes.

However, a dimension of the heat sink along a width direction thereof is limited by the condenser sections of the heat pipes, whereby a contact area between the heat sink and the heat absorption board is limited, resulting in that a heat dissipating area between the heat sink and the heat absorption board is limited.

What is needed, therefore, is a heat dissipation device which can overcome the described limitations, and an LED lamp using the same.

BRIEF DESCRIPTION OF THE DRAWINGS

Many aspects of the present embodiments can be better understood with reference to the following drawings. The components in the drawings are not necessarily drawn to scale, the emphasis instead placed upon clearly illustrating the principles of the present embodiments. Moreover, in the drawings, like reference numerals designate corresponding parts throughout the various views.

DETAILED DESCRIPTION

Figure 1:
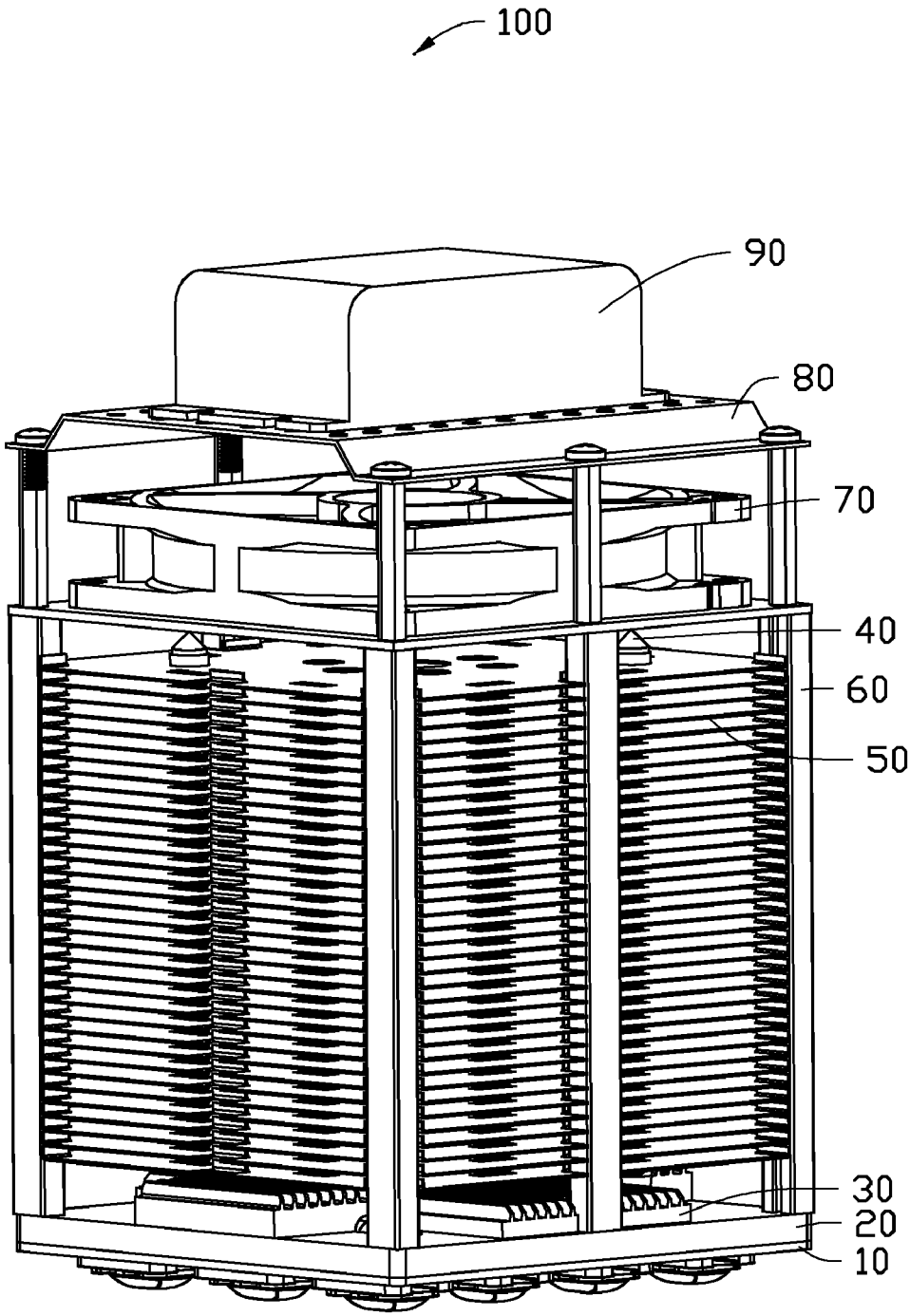
FIG. 1 is an isometric, assembled view of an LED lamp in accordance with an embodiment of the disclosure.
Figure 2:
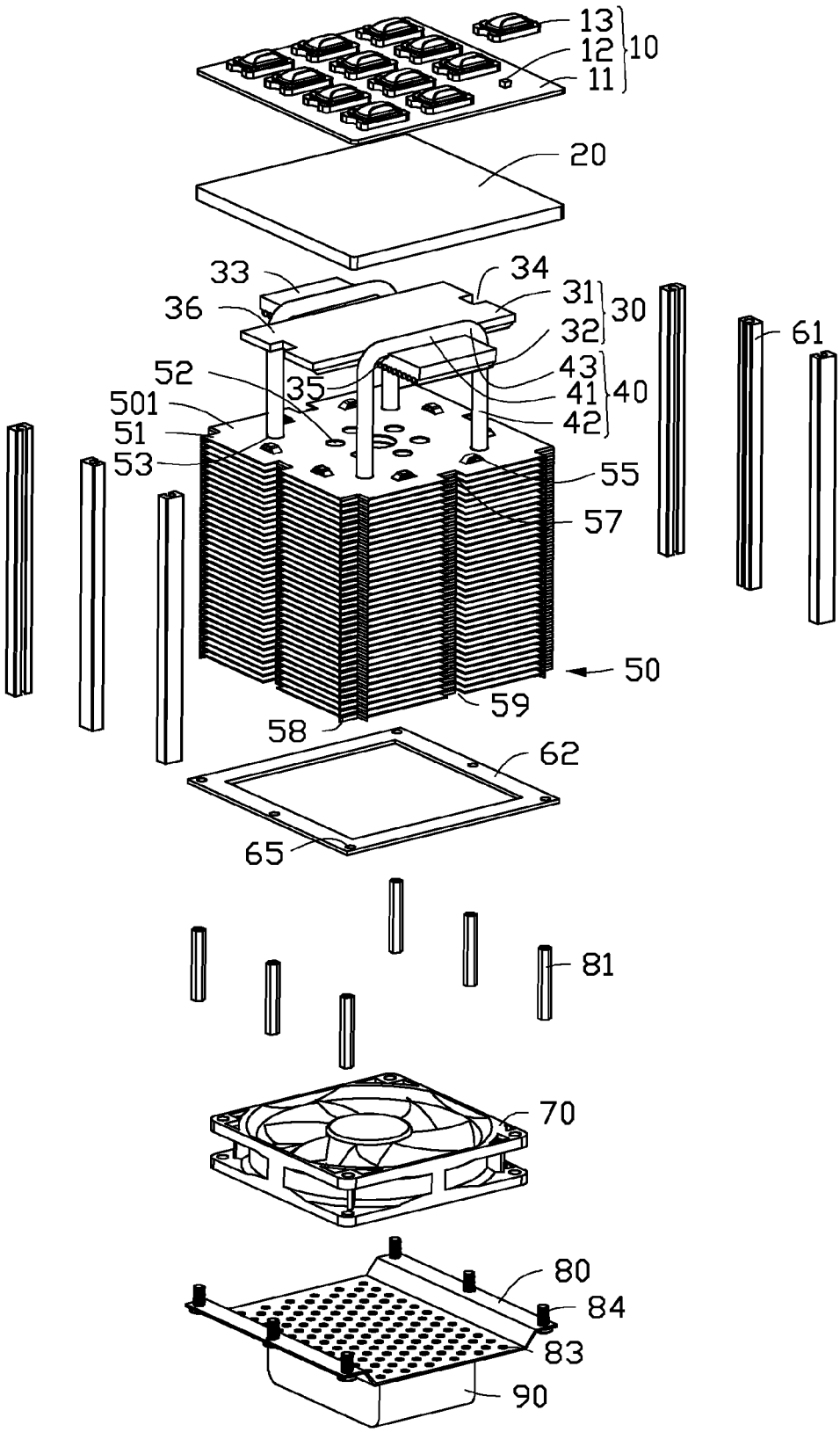
FIG. 2 is an inverted, exploded view of the LED lamp of FIG. 1.

Referring to FIGS. 1-2, an LED lamp 100 in accordance with an embodiment of the disclosure is illustrated. The LED lamp 100 comprises a light source 10, a heat absorption board 20 for absorbing heat generated by the light source 10, a heat sink 30 attached to the heat absorption board 20, a fin assembly 50 located over the heat absorption board 20, two heat pipes 40 thermally connecting the heat absorption board 20 and the fin assembly 50, a fan 70 located over the fin assembly 50, a fan holder 60 fixing the fan 70 on the fin assembly 50, a fan guard 80 positioned over the fan 70 to protect the fan 70 from contamination and damage during operation, and a driving module 90 positioned on the fan guard 80. The heat sink 30 is located between the heat absorption board 20 and the fin assembly 50, and contacts the heat pipes 40.

The light source 10 comprises a planar substrate 11, a plurality of LEDs 12 evenly attached to the substrate 11, and a plurality of lenses 13. The lenses 13 have one-to-one corresponding relationships with respect to the LEDs 12, and cover corresponding LEDs 12. The LEDs 12 bestrew the whole substrate 11.

Figure 3:
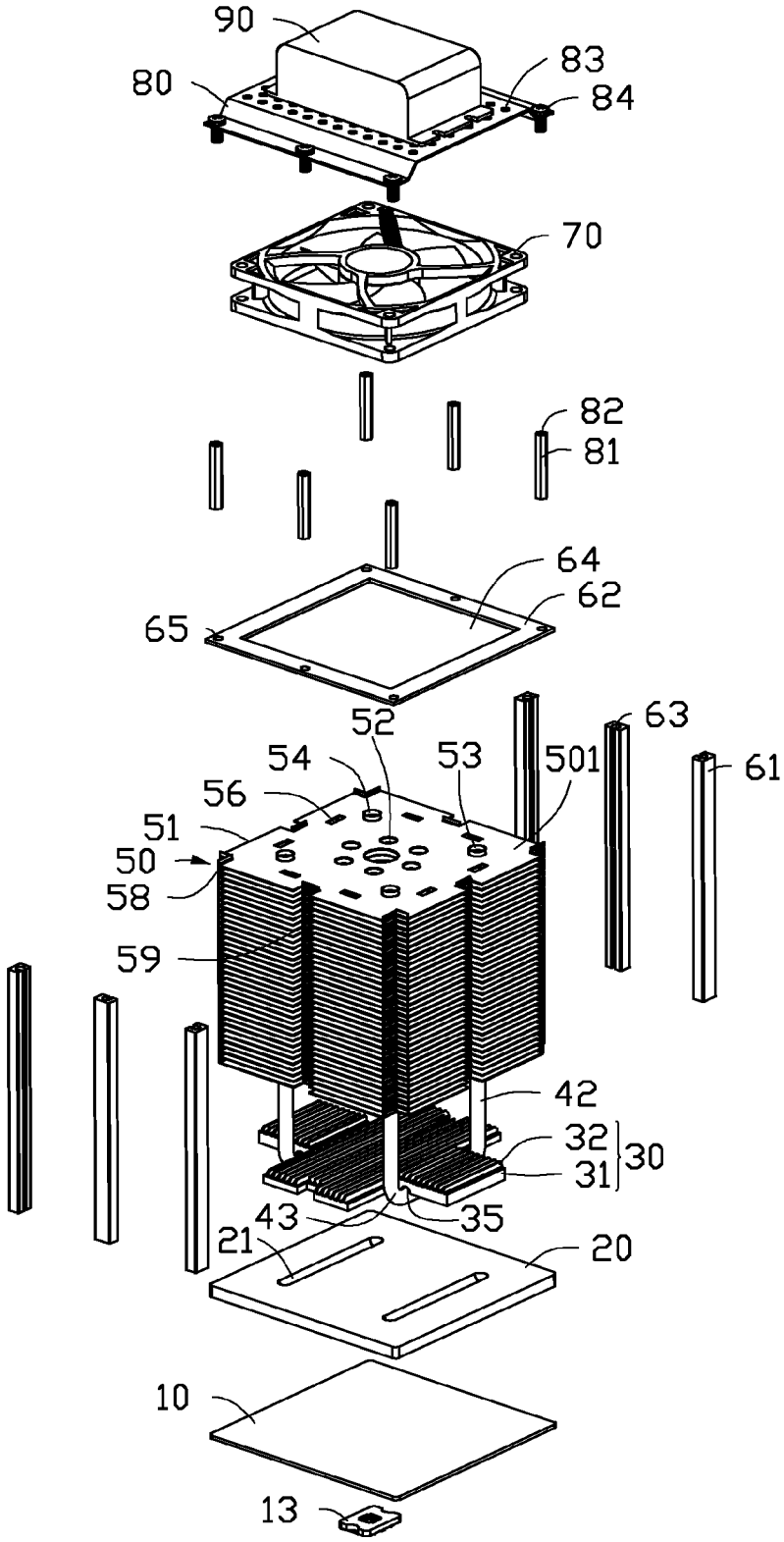
FIG. 3 is an exploded view of the LED lamp of FIG. 1.

The heat absorption board 20 is made of a metal or alloy with a high heat conductivity coefficient, such as copper, copper alloy, or other suitable material. The heat absorption board 20 has a planar configuration. The substrate 11 of the light source 10 is attached to the heat absorption board 20. A top surface area of the substrate 11 is identical to a bottom surface area of the heat absorption board 20, whereby the heat absorption board 20 absorbs heat generated by every LED 12. An outer circumferential surface of the substrate 11 is coplanar with an outer circumferential surface of the heat absorption board 20. Referring also to FIG. 3, two parallel slots 21 are defined in a top surface of the heat absorption board 20. Each of the slots 21 has a semicircular cross section.

The heat sink 30 is made of a metal or alloy having a good thermal conductivity, such as copper, aluminum or an alloy thereof. In this embodiment, the heat sink 30 is integrally formed by aluminum extrusion. In other embodiments, the heat sink 30 may be formed by stacked fins.

The heat sink 30 comprises a base 31 having a flat bottom surface and a plurality of fins 32 extending upwardly from the base 31. The flat bottom surface of the base 31 thermally contacts the top surface of the heat absorption board 20.

The base 31 comprises a pair of first heat dissipating branches 33 and a pair of second heat dissipating branches 36. The first, second heat dissipating branches 33, 36 extend outwardly from a central portion of the base 31 and are alternate with each other. The first, second heat dissipating branches 33, 36 extend outwardly to align with the outer circumferential surface of the heat absorption board 20, thereby increasing a contact area between the heat sink 30 and the heat absorption board 20. The first heat dissipating branches 33 are perpendicular to the second heat dissipating branches 36. The pair of second heat dissipating branches 36 define two gaps 34 in two opposite ends thereof. The second heat dissipating branches 36 are located between the heat pipes 40. Each of the first heat dissipating branches 33 defines a groove 35 in a bottom surface thereof. The grooves 35 and the slots 21 of the heat absorption board 20 cooperatively define two receiving channels (not labeled).

Each of the heat pipes 40 is U-shaped. The two heat pipes 40 are parallel to and spaced from each other. Each heat pipe 40 comprises a horizontal evaporator section 41, two vertical condenser sections 42 extending upwardly from two opposite ends of the evaporator section 41, and two connecting sections 43 connecting the evaporator section 41 and the condenser sections 42. The evaporator sections 41 are received in the receiving channels cooperatively formed by the grooves 35 of the first heat dissipating branches 33 and the slots 21 of the heat absorption board 20. Each of the first heat dissipating branches 33 is located between two condenser sections 42 of a corresponding heat pipe 40. The condenser sections 42 extend upwardly through the fin assembly 50.

Figure 4:
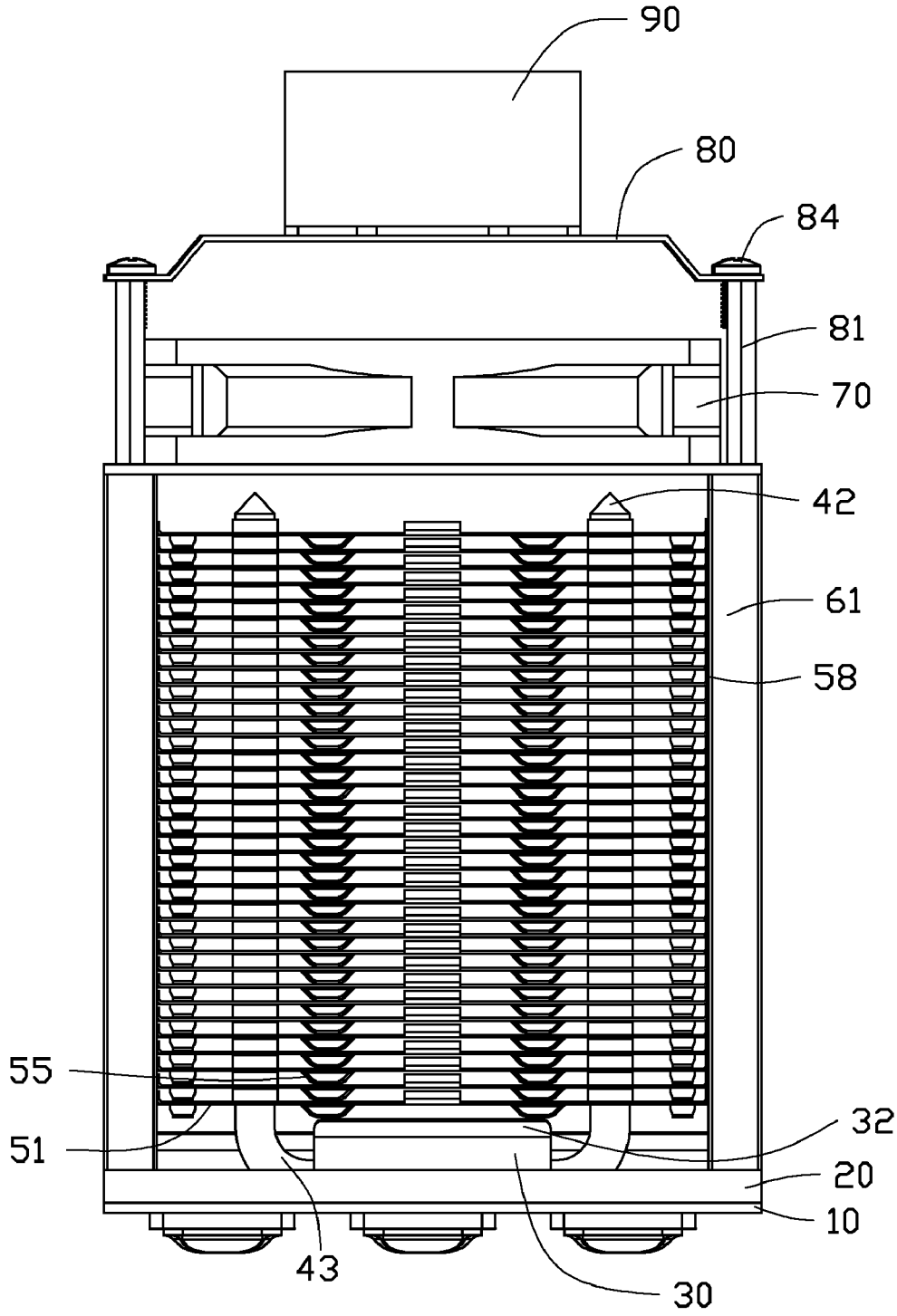
FIG. 4 is a front plan view of the LED lamp of FIG. 1.

Referring also to FIG. 4, a height of the heat sink 30 with respect to the top surface of the heat absorption board 20 is slightly larger than a height of each connecting section 43 with respect to the top surface of the heat absorption board 20, whereby the heat sink 30 makes a full use of a space defined by the connecting sections 43 of the heat pipes 40 over the top surface of the heat absorption board 20.

The fin assembly 50 comprises a plurality of vertically stacked fins 501. Each of the fins 501 comprises a main body 51. The main body 51 is rectangular, and defines a plurality of first through holes 52 for ventilating and a plurality of second through holes 53 therein. The first through holes 52 are located in a central portion of the main body 51. The second through holes 53 are located around the first through holes 52. A plurality of flanges 54 extend upwardly from the main body 51. Each flange 54 is located around a corresponding one of the second through holes 53. The second through holes 53 receive the condenser sections 42 of the heat pipes 40 therein, and the flanges 54 are engaged with the condenser sections 42.

The main body 51 of each fin 501 defines a plurality of punched ventilating holes 56 in an outer edge portion thereof. The punched ventilating holes 56 are evenly arranged in the outer edge portion of the main body 51. Corresponding to the ventilating holes 56, bending sheets 55 are disposed below the main body 51.

Each fin 501 defines a plurality of cutouts 57 in an outer edge thereof. The cutouts 57 are evenly arranged in the outer edge of the fin 501. Bending boards 58 are bent upwardly from the main body 51 of each fin 501 corresponding to the cutouts 57. The bending boards 58 of each fin 501 abut folding portions between the bending boards 58 and the main body 51 of the upper adjacent fin 501, thereby providing an interval between the two adjacent fins 501. When the fins 501 are stacked together, the bending boards 58 of the fins 501 corresponding to the same cutout 57 are stacked together, thereby defining a receiving space 59. The receiving spaces 59 face to an outside of the fin assembly 50.

The fan holder 60 comprises a supporting board 62 located over a top of the fin assembly 50 and a plurality of supporting posts 61 mounted on an outer edge of the heat absorption board 20 and supporting the supporting board 62. Each of the supporting posts 61 has a rectangular cross section. Each supporting post 61 defines an extending groove 63 along a length direction thereof. The extending groove 63 extends through a lateral side of the supporting post 61 to communicate with ambient air. The supporting posts 61 are received into the receiving spaces 59 of the fin assembly 50; that is, the supporting posts 61 are embedded into the receiving spaces 59 of the fin assembly 50. Outer side surfaces of the supporting posts 61 exposed out of the receiving spaces 59 are coplanar with outer side surfaces of the fin assembly 50.

The supporting board 62 has a rectangular configuration. The supporting board 62 defines a window 64 in a central portion thereof, by which the airflow generated by the fan 70 can flow through the supporting board 62. The fan 70 is mounted on an inner edge of the supporting board 62. The supporting board 62 defines a plurality of joining holes 65 in an outer edge thereof. The joining holes 65 correspond to the supporting posts 61.

The fan guard 80 is positioned over the fan 70 via a plurality of threaded poles 81. Each threaded pole 81 defines a threaded hole 82 at an end thereof and along a length direction thereof. The threaded poles 81 extend through the joining holes 65 to be engaged into the extending grooves 63 of the supporting posts 61. A plurality of screws 84 extend through an outer edge of the fan guard 80 to be screwed into the threaded holes 82 of the threaded poles 81, whereby the fan guard 80 is mounted over the fan 70. The fan guard 80 defines a plurality of meshes 83 therein for ventilating.

The driving module 90 is mounted at a central portion of the fan guard 80. The driving module 90 provides a driving voltage for the light source 10 and the fan 70.

In assembly of the LED lamp 100, the light source 10 is attached to the top surface of the heat absorption board 20. The heat sink 30 is attached to the bottom surface of the heat absorption board 20. The condenser sections 42 of the heat pipes 40 are sandwiched between the heat sink 30 and the heat absorption board 20. A plurality of fasteners (not shown) extend upwardly through the substrate 11 of the light source 10 and the heat absorption board 20, and are screwed into the extending grooves 63 of the supporting posts 61, whereby the supporting posts 61 are secured to the outer edge of the heat absorption board 20, wherein two of the supporting posts 61 have bottom ends thereof received in the gaps 34 of the second heat dissipating branches 36. The supporting board 62 is secured to tops of the supporting posts 61 via the threaded poles 81. The screws 84 secure the fan guard 80 to tops of the threaded poles 81.

When the LEDs 12 work, heat generated by the LEDs 12 is evenly absorbed by the heat absorption board 20. The evaporator sections 41 of the heat pipes 40 absorb a part of heat from the heat absorption board 20, and transfer the part of heat to the fin assembly 50. The fin assembly 50 dissipates the part of heat to ambient air. At the same time, the heat sink 30 absorbs the other part of heat from the heat absorption board 20, and dissipates the other part of heat to ambient air.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat dissipation device comprising:

a heat absorption board adapted for contacting a light source to absorb heat therefrom;

a fin assembly located over the heat absorption board;

two spaced heat pipes each comprising an evaporator section and two condenser sections extending from two opposite ends of the evaporator section, the condenser sections extending through the fin assembly; and a heat sink located between the heat absorption board and the fin assembly, the evaporator sections of the heat pipes being sandwiched between the heat sink and the heat absorption board, the heat sink comprising a pair of first heat dissipating branches and a pair of second heat dissipating branches extending outwardly from a central portion thereof, the first heat dissipating branches and the second heat dissipating branches being alternate with each other, the first heat dissipating branches contacting the evaporator sections of the heat pipes, the second heat dissipating branches being located between the heat pipes.

2. The heat dissipation device of claim 1, wherein the first heat dissipating branches and the second heat dissipating branches extend outwardly to align with an outer circumferential surface of the heat absorption board, thereby increasing a contact area between the heat sink and the heat absorption board.

3. The heat dissipation device of claim 1, wherein the first heat dissipating branches of the heat sink are perpendicular to the second heat dissipating branches.

4. The heat dissipation device of claim 1, wherein each of the first heat dissipating branches is located between the condenser sections of a corresponding heat pipe.

5. The heat dissipation device of claim 1, wherein each heat pipe further comprises two connecting sections connecting the evaporator section and the condenser sections thereof, a height of the heat sink with respect to a surface of the heat absorption board near the fin assembly being slightly larger than a height of each connecting section with respect to the surface.

6. The heat dissipation device of claim 1 further comprising a fan and a fan holder fixing the fan on a top of the fin assembly, wherein the fan holder comprises a supporting board located over the top of the fin assembly and a plurality of supporting posts mounted on an outer edge of the heat absorption board and supporting the supporting board, the supporting posts being embedded into the fin assembly.

7. The heat dissipation device of claim 6, wherein outer side surfaces of the supporting posts exposed out of the fin assembly are coplanar with outer side surfaces of the fin assembly.

8. The heat dissipation device of claim 6 further comprising a fan guard positioned over the fan and a driving module mounted on the fan guard, wherein the fan guard defines a plurality of meshes therein for ventilating.

9. An LED lamp comprising:

a light source comprising a plurality of LEDs; and a heat dissipation device comprising a heat absorption board contacting the light source for absorbing heat generated by the LEDs, a fin assembly located over the heat absorption board, two spaced heat pipes, and a heat sink located between the heat absorption board and the fin assembly;

wherein each heat pipe comprises an evaporator section and two condenser sections extending from two opposite ends of the evaporator section, the condenser sections extend through the fin assembly, the evaporator sections of the heat pipes are sandwiched between the heat sink and the heat absorption board, the heat sink comprises a pair of first heat dissipating branches and a pair of second heat dissipating branches extending outwardly from a central portion thereof, the first and second heat dissipating branches are alternate with each other, the first heat dissipating branches contact the evaporator sections of the heat pipes, the second heat dissipating branches are located between the heat pipes.

10. The LED lamp of claim 9, wherein the first, second heat dissipating branches of the heat sink extend outwardly to an outer circumferential surface of the heat absorption board, thereby increasing a contact area between the heat sink and the heat absorption board.

11. The LED lamp of claim 9, wherein the first heat dissipating branches of the heat sink are perpendicular to the second heat dissipating branches.

12. The LED lamp of claim 9, wherein each of the first heat dissipating branches is located between the condenser sections of a corresponding heat pipe.

13. The LED lamp of claim 9, wherein each heat pipe further comprises two connecting sections connecting the evaporator section and the condenser sections thereof, a height of the heat sink with respect to a surface of the heat absorption board near the fin assembly being slightly larger than a height of each connecting section with respect to the surface.

14. The LED lamp of claim 9, wherein the heat dissipation device further comprises a fan and a fan holder fixing the fan on a top of the fin assembly, the fan holder comprising a supporting board located over the top of the fin assembly and a plurality of supporting posts mounted on an outer edge of the heat absorption board and supporting the supporting board, the supporting posts being embedded into the fin assembly.

15. The LED lamp of claim 14, wherein outer side surfaces of the supporting posts exposed out of the fin assembly are coplanar with outer side surfaces of the fin assembly.

16. The LED lamp of claim 9, wherein the light source further comprises a substrate contacting the heat absorption board, the LEDs being attached to the substrate, a top surface area of the substrate being identical to a bottom surface area of the heat absorption board.

* * * * *